United States Patent [19]

Hart et al.

[11] 3,986,654

[45] Oct. 19, 1976

[54] METHOD FOR MAKING TUBULAR MEMBERS AND PRODUCT THEREOF

[75] Inventors: William Hart, Ramona; K. Stewart Peters, El Cajon; John C. Tverberg, El Cajon; Donald H. Wiese, El Cajon, all of Calif.

[73] Assignee: Carpenter Technology Corporation, Reading, Pa.

[22] Filed: Nov. 5, 1975

[21] Appl. No.: 629,118

[52] U.S. Cl. ..... 228/155; 72/342; 72/370; 72/378

[51] Int. Cl.[2] ..... B21D 31/04

[58] Field of Search ..... 72/295, 302, 342, 364, 72/370, 378; 228/151, 155; 29/423, 447, DIG. 21, DIG. 24, DIG. 41, DIG. 42; 148/130, 131; 219/8.5, 59

[56] References Cited

UNITED STATES PATENTS

| | | | |
|---|---|---|---|
| 1,409,562 | 3/1922 | Mason | 29/423 |
| 3,298,096 | 1/1967 | Stuart | 228/151 |
| 3,315,513 | 4/1967 | Ellenburg | 72/342 |
| 3,383,900 | 5/1968 | Van Hartesveldt | 72/342 |

*Primary Examiner*—Lowell A. Larson
*Attorney, Agent, or Firm*—Edgar N. Jay

[57] ABSTRACT

A process for making tubes, channels and other relatively thin-walled elongated shapes having a unique degree of dimensional accuracy and stability in which the part after being shaped and only approximately sized is mounted on a mandrel having a larger coefficient of thermal expansion than the part. The mandrel and the part are connected at their opposite ends so that expansion of the mandrel first causes elongation and concomitant lateral shrinkage of the part and then lateral expansion of the part so that it is triaxially hot worked to bring it to its final hot size from which the part contracts to its finished size at room temperature. For maximum freedom from residual stresses and dimensional stability thermal sizing is carried out by heating to a temperature at least just above the recrystallization temperature of the part.

23 Claims, 4 Drawing Figures

METHOD FOR MAKING TUBULAR MEMBERS AND PRODUCT THEREOF

BACKGROUND OF THE INVENTION

This invention relates to a process for making tubes and other relatively thin-walled elongated shapes which facilitates attainment of a high degree of dimensional accuracy and stability and, more particularly, to such a process which is especially well suited for making such tubes and shapes which must have and retain a high degree of dimensional accuracy and stability after having been subjected to temperature cycling over an extremely broad range.

In the manufacture of elongated hollow shapes to precise, narrow tolerances, it has hitherto been known to utilize a technique frequently called "thermal sizing" in which the sizing force is the differential thermal expansion between two dissimilar materials. One of the materials is that of which the hollow elongated body is formed. The second material, which may be in the form of a mandrel to be enclosed by the body, is chosen so that its coefficient of thermal expansion is sufficiently greater than that of the body to be sized as to have the desired effect. The sizing force is developed when the body to be sized and the mandrel enclosed within it are heated and results from a change in the diameter or periphery of the mandrel with increasing temperature which stretches the body radially so as to increase its periphery.

Such a process is described by J. N. Suldan and R. J. Krahn* who used cast ductile iron having a coefficient of expansion of about $7.6 \times 10^{-6}$°$F^{-1}$ ($13.68 \times 10^{-6}$°$C^{-1}$) and A.I.S.I. type 304 stainless steel with a coefficient of expansion of about $10.2 \times 10^{-6}$°$F^{-1}$ ($18.36 \times 10^{-6}$°$C^{-1}$) to accomplish thermal sizing of tubes or cans made of Zircaloy-4 having a coefficient of expansion equal to about $3.6 \times 10^{-6}$°$F^{-1}$ ($6.48 \times 10^{-6}$°$C^{-1}$); the stainless steel being used to accomplish the thermal sizing at a lower temperature than required for a mandrel formed of ductile iron. In that process, Zircaloy-4 strip, after being formed to the required thickness with a ± 0.004 inch (0.01 cm) tolerance, was shaped to semicylindrical shells having an internal radius equal to the external radius of the mandrel to be used for machining, welding and sizing the Zircaloy-4 tube. The strip was then mounted on the mandrel and TIG (tungsten inert gas) welded along the two longitudinal seams. Sizing was then carried out by annealing in vacuum at a temperature ranging from 900° to 1450°F (482° to 788°C), using the cast iron mandrel, and from 900°F to 1170°F (482° to 632°C), using the type 304 stainless steel mandrel. The thus formed tubes were then removed from the mandrels once the parts had cooled, and the tubes were checked, using contacting dial indicators, to determine dimensional accuracy.

*"Sizing of Zircaloy Structurals", February 1967, WAPD-TM-620, available from Clearinghouse for Federal Scientific and Technical information, National Bureau of Standards, U.S. Dept. of Commerce, Springfield, Va. 22151; abstract published Nuclear Science Abstracts Vol. 21, No. 11, June 15, 1967.

Suldan and Krahn indicate that

"a second sizing cycle, at the same temperature as the first and with the can rotated on the mandrel, may be required in order to achieve the required tolerances".*

*Ibid., p. 12.

Essentially the same process is described in U.S. Pat. No. 3,559,278 according to which a split sheet metal tubular body of the tube material is mounted on a mandrel which has a coefficient of linear expansion which is at least twice that of the tube material. The tube material is butt welded to form a tube on the mandrel with surface-to-surface contact between the thus formed tube and the mandrel. The tube and mandrel assembly are then heated to a temperature high enough for the mandrel to create sufficient tangential stress radially to expand the tube so that, upon cooling, the tube has the required lateral dimensions. The patent also points out that the straightness of the tube can be further improved by stretching it after the thermal sizing treatment.

Such processes have made possible the production of elongated hollow bodies to closer tolerance than had been previously possible; nevertheless, they left much to be desired. As was seen, one disadvantage resided in the need for repetitive thermal sizing in order to get the most out of the process. Further, such processes required that the tube or body-forming material be closely fitted to the mandrel, surface-to-surface contact being preferred in order to attain the desired thermal sizing. For many intended uses, even greater dimensional accuracy and stability, freedom from residual stresses and from distortion resulting from thermal cycling is desirable than was heretofore attainable.

SUMMARY OF THE INVENTION

It is, therefore, a principal object of this invention to provide a process for making tubes and other relatively thin-walled elongated shapes on a commerical basis characterized by a high degree of reliability, which produces products having a unique degree of dimensional accuracy and stability which is retained through repeated temperature cycling, and which is combined with a unique degree of freedom from surface and other mechanical defects.

A more specific object of this invention is to provide such a process which is especially suited for the manufacture of polygonal tubing from material having a desirable thermal neutron capture cross section characterized by a unique degree of dimensional accuracy and stability and freedom from mechanical defects and residual stresses so as to meet the exacting standards required for use in nuclear reactors.

In carrying out the process of the present invention, hollow elongated members are simultaneously subjected to longitudinal stress (parallel to the longitudinal axis) and tangential stress during thermal sizing at an elevated temperature so that, upon cooling, the body is longer and has a larger periphery than at the start, and its lateral dimensions fall within extremely narrow tolerances determined by the dimensions of the mandrel, the differential expansivity between the two and the temperature to which the assembly had been heated. The process can be used in making a wide variety of elongated hollow shapes and is most advantageously used in making members which have a circular cross section having a minimum degree of ovality and members which have a non-circular cross section so long as the cross section of the member is substantially free of transitions from end to end which would preclude removal of the members from the mandrel. For thermal sizing, the body is mounted on a mandrel having a coefficient of thermal expansion which is sufficiently larger than that of the body so that the body is stretched longitudinally so as to be initially reduced laterally and then, on engaging the mandrel, is expanded laterally by the mandrel sufficiently to provide the required lateral dimensions at room temperature.

DESCRIPTION OF THE DRAWING

Further objects as well as advantages of the present invention will be apparent from the following detailed description thereof and the accompanying drawing in which.

DESCRIPTION OF PREFERRED EMBODIMENTS

Figure 1:
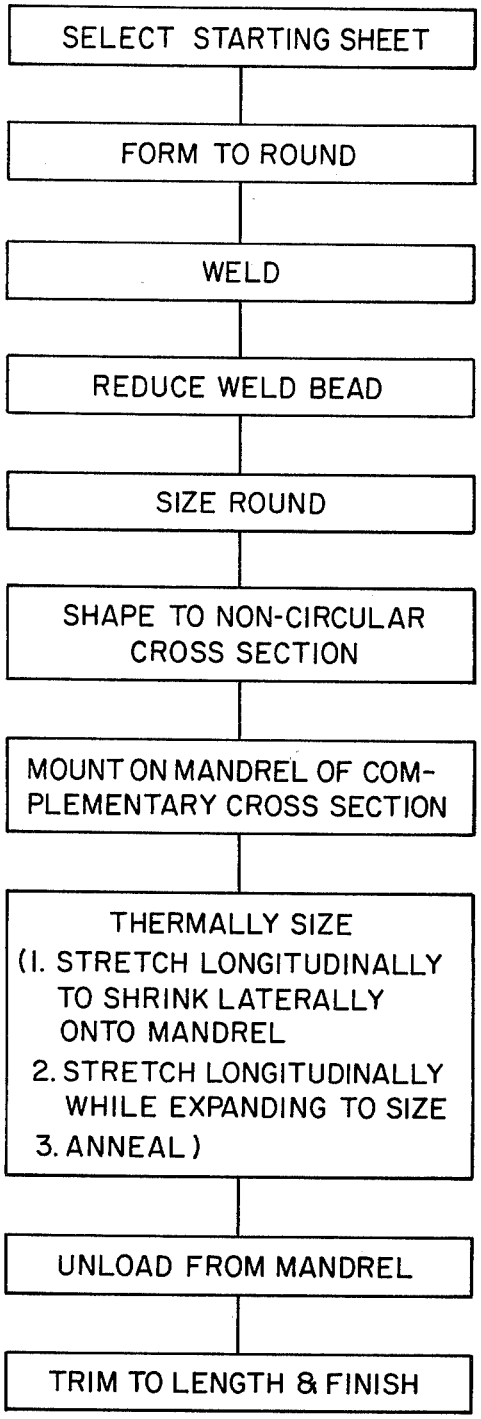
FIG. 1 is a flow chart of a preferred embodiment of the invention.

It is to be understood that the bodies can be prepared for thermal sizing in accordance with the present invention in a wide variey of ways, but further advantages can be obtained in the manufacture of precision tubing without or with a seam such as is formed by welding when the bodies are prepared as will be described hereinbelow. Such welded tubes may each be prepared from a single strip of the desired material having the required width and length so as to minimize twist in the tube after it has been formed. The strip is formed into a substantially cylindrical shape with its longitudinal edges in opposed relation. The edges are joined preferably by TIG welding. In certain applications where straightness is critical and deviation from straightness must be minimized, one or more longitudinal non-closure welds may be formed to balance the member structurally. When one additional weld is to be formed, the additional welding operation is carried out directly opposite the longitudinal edges of the strip, that is to say, along a line substantially midway between the edges and extending the length of the strip. When the opposed weld is carried out before the edges are welded together, the edges can be used as a reference for guiding the welding head along the strip. Such welding can also be carried out on the flat sheet before it is formed. When the edges of the strip are welded first, a locating line for the opposed weld can be simultaneously scribed which is then followed during a second welding pass. The weld bead or beads are removed or reduced to the desired extent in any suitable way, and then the welded body is shaped to the desired form and approximately to the finished size; that is, close enough to the finished size that final sizing can be carried out using thermal sizing techniques.

When the finished product is to be a nuclear fuel channel, particularly one that is non-circular in cross section, it is desirable to minimize retained stresses, and, to this end, the body may be annealed at a high enough temperature to eliminate stresses such as may be created by the cold working incident to eliminating the weld bead and cold sizing. In the case of zirconium or zirconium alloy tubing, stress relief annealing can be carried out at a temperature ranging from about 600°F (316°C) to about 1400°F (760°C) or higher depending upon the condition of the part. The particular temperature at which such annealing treatments are carried out is not at all critical, it only being necessary that the part be substantially free of stress to facilitate cold forming to the desired non-circular (in cross section) shape.

Thus, in practice, the part may be annealed following elimination of the weld bead and again following sizing to a round.

Sizing to a round having the desired radius for mounting on a cylindrical mandrel or for forming to a polygonal cross section for mounting on a polygonal mandrel to be used in thermal sizing is preferably carried out by passing the tube through a die without a mandrel, whereby the outer diameter of the tube is reduced without modifying the thickness of the material thereby making it unnecessary to control the inner diameter. For cylindrical tubing, the tube may then be mounted on a cylindrical mandrel. In the case of a polygonal tubing end product such as one having a square cross section, the tube is first shaped to a square using conventional equipment and techniques. Particularly when the material of which the part is formed is sensitive to galling and other surface blemishes which must be avoided, the size of the square to which the round is formed is sufficiently larger than that of the thermal-sizing mandrel to facilitate insertion of the mandrel without damaging or marring the surface of the tube. In any event, the present process eliminates the need to shape the round to within the precise tolerances required of the finished part whether circular or non-circular or to such close conformity to the size of the mandrel as would tend to lead to marring of the surface of the tube being formed.

As has long been known, thermal sizing is carried out by selecting material of which the mandrel is formed having a coefficient of expansion sufficiently greater than that of the part being sized so that, upon heating in an inert atmosphere, e.g., vacuum or a gas such as argon, the part is forced by the mandrel to expand to an extent depending upon the temperature to which the assembly is heated. In the case of such members as zirconium alloy channel members, one suitable mandrel material is A.I.S.I. type 304 stainless steel which provides a desirable degree of mismatch as to coefficients of thermal expansion.

In accordance with an important feature of the present invention, the mandrel is inserted into the part and, while on the mandrel, the part is triaxially stressed. That is, the part is stretched longitudinally and simultaneously the periphery of the part is increased while it is being heated to its annealing temperature. Preferably, this is carried out by anchoring the opposite-end portions of the part of members such as blocks which, in their starting positions, abut and are each forced to move with opposite ends of the longitudinally expanding mandrel and thus stretch the part. Upon cooling and contraction of the assembly, the slower contracting part restrains the blocks so that the associated end of the mandrel moves away, leaving each of the blocks in a second position spaced from that end of the mandrel. The distance between each of the blocks and the associated ends of the mandrel is determined by the differential expansion between the part and the mandrel and the temperature to which the assembly is heated. Both the part and the mandrel expand bidirectionally, that is, laterally and longitudinally, the extent to which each expands being determined by its own coefficient of expansion. In this case, the differential expansion is determined by the difference between the greater expansivity of the mandrel over that of the part and causes the part to be expanded laterally by the much greater lateral expansion of the mandrel and to be stretched longitudinally by the much greater longitudinal expansion of the mandrel.

As was noted hereinabove, an important advantage of the present invention resides in the freedom from surface defects resulting from the part being substantially larger than the mandrel. Indeed, the mismatch is large enough so that unless the transverse dimensions of the part are reduced during annealing the expansivity of the mandrel is not great enough to carry its surface into contact with the interior surface of the part at a low enough temperature for the mandrel to effectively stretch the part tangentially by the time the assembly is brought to the annealing temperature. In some instances, the part may be so much larger than the mandrel that heating the assembly to the maximum tolerable annealing temperature without shrinking the width of the part does not bring their surfaces into contact. In accordance with the present invention, by connecting or anchoring the ends of the part to the ends of the mandrel, initial elongation of the mandrel, which is at a significantly greater rate than that of the part, serves to longitudinally stretch the part, and this, in turn, serves to draw the part down onto the surface of the mandrel. The coefficients of expansion of the materials are so mismatched that this occurs well below the desired annealing temperature so that further heating to the higher temperature causes the mandrel to expand the part laterally back to the precise size contraction from which, on cooling to room temperature, gives the required finished transverse dimensions. The length is readily adjusted by trimming off excess. In this way, the part is triaxially hot worked preferably above its recrystallization temperature as will be more fully pointed out hereinbelow.

The connection between the part and the mandrel during thermal sizing and annealing can be made in any convenient way so long as the part, during the more rapid expansion of the mandrel, has its ends anchored to the ends of the mandrel so that the part is stretched, thereby causing it to be shrunk down laterally onto the mandrel with the inner surface of the part against the outer surface of the mandrel. Raising further the temperature of the assembly results in further longitudinal stretching and simultaneous lateral stretching of the part by the mandrel.

The advantages of the present invention are best attained when heating of the part and the mandrel assembly is carried to a temperature at least just above the recrystallization temperature of the part and then is held at that temperature long enough for complete stress relief. In each specific case, the upper temperature to which the assembly is heated above the recrystallization temperature is determined by both the mismatch in size and expansivity between the part and the mandrel, and also the room temperature dimensions required in the finished product.

The process in practice facilitates the manufacture of long, 10 feet or more, tubular members and is most advantageously used in the manufacture of members of circular and non-circular cross section to extremely close tolerances. The extremely small variation in dimensions, minimal bow and twist, providing a unique degree of straightness characteristic of the present process, makes it especially well suited for use in the manufacture of nuclear fuel channels from such difficult-to-fabricate materials as the zirconium alloys used to duct coolant around the fuel elements in a boiling water reactor.

When the starting material used in carrying out the present process is seamless tubing and depending upon the dimensions required in the end product, the seamless tubing may or may not be sized to a more precise round before shaping to a non-circular cross section and/or mounting on the mandrel. Similarly, in the production of welded circular tubing, the welded tube with or without additional non-closure welds may be mounted on the mandrel with or without further preliminary sizing and even without reducing the weld bead.

In carrying out a preferred embodiment by way of exemplifying the present invention, a sheet having the composition of Zircaloy-4 alloy, having suitable dimensions, and free of surface defects was formed to a round and sealed by TIG welding the opposite longitudinal edges of the sheet to form a butt weld while, at the same time, a line was scribed directly opposite the weld. A second welding pass was then made along the line to form a second weld zone opposed to the first, which formed the channel, to substantially avoid or minimize bowing or other disturbing effects resulting from providing a weld only along one side of the channel. Following reduction of the weld bead, the channel was then vacuum annealed to relieve stresses and sized to the desired round cross section preparatory to forming to a square section. Sizing to a round is preferably done without a mandrel so that variations in wall thickness cannot be caused by this process step so that only the outer dimension (O.D.) of the part must be controlled. The round channel was then formed to a non-circular cross section; in this instance, it was passed through a Turk's head and formed into a square. The dimensional precision of such forming is good and more than satisfactory for many uses, but leaves much to be desired when extreme dimensional precision is required over relatively long lengths.

To achieve the unique degree of freedom from residual stress and dimensional accuracy characteristic of products of the present process, the channel is thermally sized and annealed above its recrystallization temperature. To this end, the channel is mounted on a mandrel of appropriate length, but substantially smaller in cross section to facilitate loading without damage to the surface of the channel because of variations in the dimensions of the channel that occur along its length as thus far formed. The O.D. of the mandrel measured from flat-to-flat is preferably about 0.055 inch (1.40 mm) less than that of the channel to assure a minimum clearance of at least about 0.030 inch (0.76 mm) wherever the channel may have minimum width. With a mandrel made from A.I.S.I. Type 304 stainless steel and a Zircaloy-4 channel, annealing at about 1250°F (677°C) provides optimum results although a somewhat higher temperature, up to about 1325°F (718°C) can be used when required to properly size the channels. Even higher temperatures could be used, but the maximum temperature that can be used is below that which results in objectionable grain growth.

Figure 2:
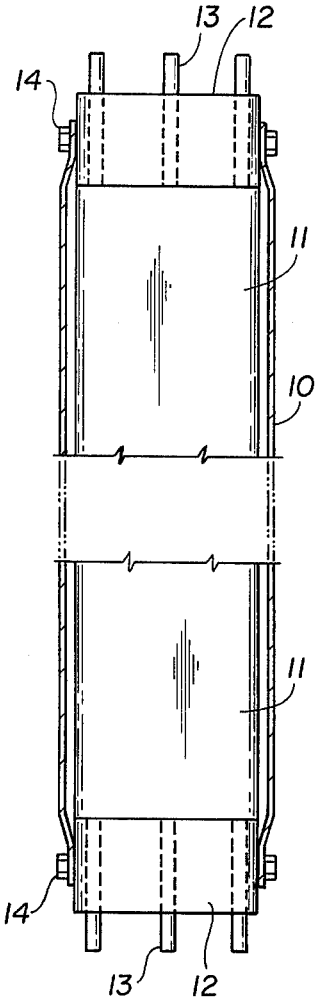
FIGS. 2 and 3 are elevational views partially in section and cut away for convenience showing a part and mandrel assembly before and after, respectively, thermal sizing.
Figure 3:
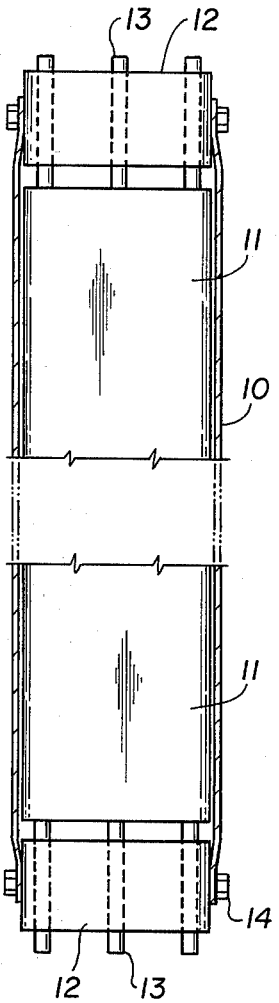

As shown in FIGS. 2 and 3, channel 10 is mounted on mandrel 11 and, at its opposite ends, is bolted to blocks 12. Each of the blocks 12 is slidable on pins 13 relative to the adjacent end of the mandrel 11, pins 13 being connected to the mandrel 11. As shown in FIG. 2, the blocks 12 abut the ends of mandrel 11 when the channel is placed thereon and anchored to the blocks by means of bolts 14. Annealing is preferably carried out in vacuum with the channel-mandrel assembly hanging vertically. As the assembly is heated to the annealing temperature $T_a$ (FIG. 4), the width of mandrel 11 increases along the line M while the width of the channel 10 initially decreases along line $C_1$. The intersection of line $C_1$ with line M represents the point when the oversize channel has been shrunk down onto the mandrel as a result of the channel being stretched by the more rapidly elongating mandrel. Further heating to the annealing temperature $T_a$ causes the mandrel 11 to continue expanding, which, in turn, expands the width of the channel 10. After completion of the annealing treatment, about one-half hour at temperature, and cooling of the assembly, the width of the mandrel 11 decreases along the line M. However, because of the change in its size, the width of channel 10 decreases along the line $C_2$. And, as shown in FIG. 3, with the assembly at room temperature, channel 10 has been stretched longitudinally, the blocks 12 being now spaced from the ends of mandrel 11. It should be recognized that the changes in dimensions and the size of the spaces between the parts have been exaggerated in the drawing to facilitate illustration. If channel 10 had not been anchored so as to elongate with mandrel 11, its width would have increased with temperature along line $C_3$.

Figure 4:
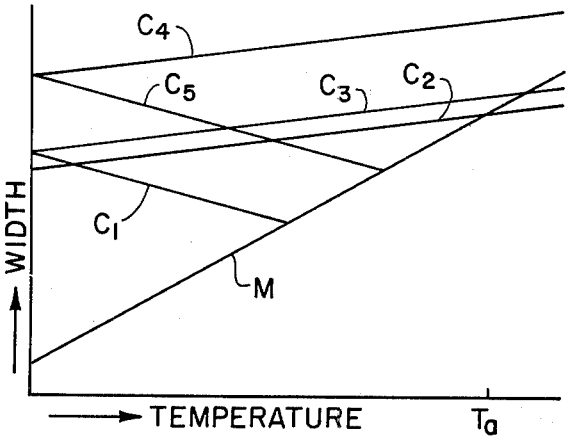
FIG. 4 is a graph qualitatively illustrating the changes in lateral dimensions of the part and mandrel during thermal sizing.

From FIG. 4, it can be seen that because of the initial difference in width between channel 10 and mandrel 11, little or no change in the size of the channel 10 would occur if channel 10 were not shrunk onto the mandrel sufficiently early in the heating cycle. The necessary skrinking of the channel 10 is brought about by the mandrel 11, because of its much larger expansivity, stretching the channel.

During cooling of the channel-mandrel assembly, the mandrel 11 contracts away from the blocks 12, the latter being anchored to the opposite ends of the more slowly contracting channel. Upon cooling to room temperature, channel 10 is readily removed from mandrel 11 without marring the surface of the channel because, once again, there is sufficient clearance.

It should be noted that, on cooling channel 10 and mandrel 11 from the annealing temperature $T_a$, the widths of each will follow the lines $C_2$ and M, respectively, as long as there is no variation in their coefficients of thermal expansion. This is true also of a channel having a somewhat larger width such as one which, if not anchored to the mandrel, would increase in width with increasing temperature along the line $C_4$, which does not intersect line M at or below the annealing temperature $T_a$. Such a channel, when anchored to the mandrel, decreases in width along the line $C_5$ until the temperature is reached, indicated by the point at which line $C_5$ intersects line M, when the channel has been shrunk into contact with the mandrel. Thereupon, expansion follows line M, and contraction with cooling follows line $C_2$.

Upon removal from the mandrel, the channel is trimmed to the required length and otherwise treated as may be required. For example, Zircaloy-4 channels can be steam autoclaved to provide a black oxide surface finish.

While the present invention has been described in connection with the formation of channel members from Zircaloy-4 alloy, other alloys can be used. In addition to the circular and non-circular members already referred to herein, it is to be noted that this process is advantageously used in the manufacture of members of three or more sides with or without lobes, which can be placed on and removed from a mandrel. In the case of channel members for nuclear reactors, the material should have a low absorption cross section for thermal neutrons. In addition to zirconium alloys, the process also lends itself to producing products from a wide variety of materials such as hard-to-shape materials as titanium, or hafnium, and alloys thereof. While a wide variety of materials can be used, preferably the material has a coefficient of thermal expansion not less than about $1.1 \times 10^{-6}$°$F^{-1}$ ($2 \times 10^{-6}$°$C^{-1}$) and no more than about $5.6 \times 10^{-6}$°$F^{-1}$ ($10 \times 10^{-6}$°$C^{-1}$).

The mandrel can be made of any suitable material having a substantially larger coefficient of thermal expansion, preferably at least twice that of the material from which the tubular parts are to be made. It is essential that the mandrel be hard enough, compared to the part at the annealing temperature, to triaxially work the part, that is, to create sufficient tangential and longitudinal stresses to hot work the material triaxially and permanently deform the material.

In describing an example of the present process in connection with welded tubing, two welded zones were created along the channel member even though only one weld was required to seal the tube. In some instances, a single weld zone may suffice, and, in others, more than two weld zones can be formed, e.g., when forming hexagonal tubing, three weld zones can be formed 120° apart.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

We claim:

1. A process for making metallic tubular members which comprises mounting an intermediate tubular member having a given cross section and a predetermined coefficient of thermal expansion on a mandrel having a cross section of substantially smaller size and having a substantially greater coefficient of thermal expansion than that of said intermediate tubular member, said mandrel being capable of plastically deforming said intermediate tubular member at elevated temperature, heating the intermediate tubular member-mandrel assembly and stretching the intermediate tubular member thereby shrinking the same onto the mandrel, continuing heating said assembly and simultaneously stressing said intermediate tubular member both longitudinally and tangentially so that the tubular member while being stretched longitudinally is simultaneously expanded laterally by the mandrel to a predetermined cross sectional size which on cooling to room temperature provides a tubular member having a predetermined finished cross sectional size, cooling said assembly to room temperature, and removing the tubular member from the mandrel.

2. A process as set forth in claim 1 which includes anchoring said intermediate tubular member to said mandrel for longitudinally stretching said intermediate tubular member while leaving it free to contract independently of said mandrel.

3. A process as set forth in claim 2 which includes heating said assembly to a temperature above the recrystallization temperature of said intermediate tubular member.

4. A process as set forth in claim 1 which includes anchoring each end of said intermediate tubular member to an end of said mandrel for longitudinally stretching said intermediate tubular member while leaving it free to contract independently of said mandrel.

5. A process as set forth in claim 4 which includes heating said assembly to a temperature above the recrystallization temperature of said intermediate tubular member.

6. A process as set forth in claim 5 which includes forming said intermediate tubular member to a substantially round cross section having a predetermined diameter before mounting it on said mandrel.

7. A process as set forth in claim 6 which includes forming said round intermediate tubular member to a non-circular cross section of a predetermined size.

8. A process as set forth in claim 7 which includes welding the opposite longitudinal edges of a sheet having said coefficient of thermal expansion to form said intermediate tubular member.

9. A process as set forth in claim 8 which includes forming at least one longitudinal weld zone along said intermediate tubular member to structurally balance the weld zone sealing the opposite edges of said sheet.

10. A process as set forth in claim 9 in which the coefficient of thermal expansion of said intermediate tubular member ranges from about $1.1 \times 10^{-6}$°$F^{-1}$ to about $5.6 \times 10^{-6}$°$F^{-1}$.

11. A process as set forth in claim 10 in which the coefficient of thermal expansion of said mandrel is at least about twice that of said intermediate tubular member.

12. A process for making welded high-precision tubular members for use in nuclear reactors which comprises the steps of selecting at least one starting sheet of a metal or alloy having a low neutron absorption cross section and having a predetermined coefficient of thermal expansion, forming said sheet to a round cross section, welding said sheet to provide a tube having a round cross section of predetermined diameter, forming at least one non-closure weld to structurally balance the closure weld formed in said tube, reducing weld bead in said tube, shaping said round tube to a non-circular cross section of a predetermined size, mounting said tube on a mandrel having a similar cross sectional shape of substantially smaller size, said mandrel being formed of a material having a substantially greater coefficient of thermal expansion than that of said starting sheet and being capable of plastically deforming said tube at elevated temperature, anchoring each end of said tube to the corresponding end of said mandrel for longitudinal expansion therewith and contraction independently thereof, heating the tube-mandrel assembly to initially stretch the tube longitudinally and thereby shrink the same onto the mandrel, continuing heating the tube-mandrel assembly so that the mandrel stresses the tube both longitudinally and tangentially so that the tube while being stretched longitudinally is simultaneously expanded laterally by the mandrel to a predetermined cross section size which on cooling to room temperature provides a tube having a predetermined finished cross sectional size, continuing heating said assembly long enough to anneal the tube, cooling said tube-mandrel assembly to room temperature and removing the tube from the mandrel.

13. A process as set forth in claim 12 in which said sheet is formed of zirconium or an alloy thereof.

14. A process as set forth in claim 13 in which said assembly is heated to a temperature above the recrystallization temperature of said tube.

15. A tubular member made by the process of claim 1.

16. A tubular member made by the process of claim 7.

17. A tubular member made by the process of claim 9.

18. A tubular member made by the process of claim 14.

19. A process as set forth in claim 1 which includes heating said assembly to a temperature above the recrystallization temperature of said intermediate tubular member.

20. A process as set forth in claim 1 which includes welding the opposite longitudinal edges of a sheet having said predetermined coefficient of thermal expansion to form said intermediate tubular member.

21. A process as set forth in claim 20 which includes forming at least one longitudinal weld zone along said intermediate tubular member to structurally balance the weld zone sealing the opposite edges of said sheet.

22. A process as set forth in claim 1 in which the coefficient of thermal expansion of said intermediate tubular member ranges from about $1.1 \times 10^{-6}$°$F^{-1}$ to about $5.6 \times 10^{-6}$°$F^{-1}$.

23. A process as set forth in claim 1 in which the coefficient of thermal expansion of said mandrel is at least about twice that of said intermediate tubular member.

* * * * *

UNITED STATES PATENT OFFICE
CERTIFICATE OF CORRECTION

PATENT NO. : 3,986,654

DATED : October 19, 1976

INVENTOR(S) : William Hart, K. Stewart Peters, John C. Tverberg and Donald H. Wiese It is certified that error appears in the above-identified patent and that said Letters Patent are hereby corrected as shown below:

Col. 1, line 33, delete "λ".

Col. 4, line 49, for the second occurrence of "of" read -- to --.

Col. 7, line 31, for "skrinking" read -- shrinking --.

Col. 10, line 10, for "section" read -- sectional --.

Signed and Sealed this

Fourth Day of January 1977

[SEAL]

*Attest:*

RUTH C. MASON
*Attesting Officer*

C. MARSHALL DANN
*Commissioner of Patents and Trademarks*